US008827263B1

(12) United States Patent
Wu et al.

(10) Patent No.: US 8,827,263 B1
(45) Date of Patent: Sep. 9, 2014

(54) PAPER FEEDING MECHANISM

(71) Applicant: Foxlink Image Technology Co., Ltd., New Taipei (TW)

(72) Inventors: Chun Lin Wu, New Taipei (TW); Wen Ching Liao, New Taipei (TW)

(73) Assignee: Foxlink Image Technology Co., Ltd., New Taipei (TW)

( * ) Notice: Subject to any disclaimer, the term of this patent is extended or adjusted under 35 U.S.C. 154(b) by 0 days.

(21) Appl. No.: 14/097,975

(22) Filed: Dec. 5, 2013

(51) Int. Cl.

| | |
|---|---|
| ***B65H 1/12*** | (2006.01) |
| ***B65H 5/06*** | (2006.01) |
| ***B65H 7/20*** | (2006.01) |
| ***B65H 3/06*** | (2006.01) |
| ***B65H 7/02*** | (2006.01) |

(52) U.S. Cl.
CPC .. *B65H 3/06* (2013.01); *B65H 5/06* (2013.01); *B65H 7/20* (2013.01); *B65H 7/02* (2013.01)
USPC ..... 271/160; 271/152; 271/147

(58) Field of Classification Search
USPC ..... 271/147, 152, 153, 154, 155, 157, 160
See application file for complete search history.

(56) References Cited

U.S. PATENT DOCUMENTS

| | | | | |
|---|---|---|---|---|
| 4,763,891 | A * | 8/1988 | Kodama | 271/157 |
| 5,419,543 | A * | 5/1995 | Nakamura et al. | 271/9.01 |
| 5,515,094 | A * | 5/1996 | Tanaka et al. | 347/104 |
| 6,783,126 | B2 * | 8/2004 | Amamoto | 271/152 |
| 6,880,822 | B2 * | 4/2005 | Fukushima et al. | 271/157 |
| 8,752,823 | B2 * | 6/2014 | Hayashi et al. | 271/160 |
| 2005/0040588 | A1 * | 2/2005 | Chang | 271/126 |

* cited by examiner

*Primary Examiner* — Ernesto Suarez
(74) *Attorney, Agent, or Firm* — WPAT, P.C.; Anthony King

(57) ABSTRACT

A paper feeding mechanism includes a mechanical frame, a drive assembly mounted to the mechanical frame, an input tray, a pickup assembly driven by the drive assembly, an elevating assembly and a control assembly. The elevating assembly mounted to the mechanical frame and pivoted to a bottom of the rear end of input tray includes a drive shaft, a gear assembly and an elastic element. The rotating shaft defines two cam parts projecting beyond the rotating shaft. The rotating shaft is capable of rotating to make the cam parts press downward on or break away from the input tray so as to drive the input tray to swing downward or swing upward under an elastic push action of the elastic element. The control assembly includes a control system and a paper sensor controlled by the control system for detecting whether there is any paper on the input tray.

5 Claims, 5 Drawing Sheets

PAPER FEEDING MECHANISM

BACKGROUND OF THE INVENTION

1. Field of the Invention

The present invention generally relates to a paper feeding mechanism, and more particularly to a paper feeding mechanism applied in an automatic document feeder.

2. The Related Art

A conventional paper feeding mechanism applied in an automatic document feeder includes a mechanical frame, an input tray, a drive assembly and a pickup assembly. The input tray is assembled to the mechanical frame. The drive assembly is mounted to the mechanical frame. The pickup assembly is driven by the drive assembly and is assembled to the mechanical frame and located above the input tray. After a stack of paper is placed on the input tray, the drive assembly drives the input tray to be raised up to a constant height according to a thickness of the stack of paper placed on the input tray, and then the pickup assembly starts picking up the paper.

However, after the pickup assembly picking up the paper for a while, the thickness of the stack of paper becomes thinner and the height of the input tray keeps constant that weakens a picking up strength of the pickup assembly exerted on the paper and even makes the pickup assembly unable to pick up the paper.

SUMMARY OF THE INVENTION

An object of the present invention is to provide a paper feeding mechanism. The paper feeding mechanism includes a mechanical frame, a drive assembly mounted to the mechanical frame, an input tray, a pickup assembly, an elevating assembly and a control assembly. The front end of the input tray is pivoted to the mechanical frame and a rear end of the input tray swings upward around the front end of the input tray to be raised up a distance from the mechanical frame. The pickup assembly is driven by the drive assembly. The elevating assembly is mounted to the mechanical frame and is pivoted to a bottom of the rear end of input tray. The elevating assembly includes a drive shaft mounted to the mechanical frame with one end thereof connecting with the drive assembly and driven by the drive assembly, a gear assembly connecting with the drive shaft, a rotating shaft driven by the gear assembly to rotate and located under the input tray, and an elastic element. The rotating shaft defines two cam parts projecting beyond the rotating shaft. The rotating shaft is capable of rotating to make the cam parts press downward on or break away from the input tray so as to drive the input tray to swing downward or swing upward under an elastic push action of the elastic element. The control assembly includes a control system and a paper sensor controlled by the control system for detecting whether there is any paper on the input tray. The control assembly controls the drive assembly to drive the elevating assembly to rise or descend so as to bring along the input tray to swing upward or downward and drive the pickup assembly to pick up the paper or stop picking up the paper.

As described above, the rotating shaft defines two cam parts projecting beyond the rotating shaft, when the two cam parts of the rotating shaft rotate to the pressing portions of the input tray, the cam parts press downward on the pressing portions so as to bring along the rear end of the input tray to swing downward for facilitating placing the stack of paper on the input tray. Furthermore, the elastic element elastically pushes against the input tray to modulate a rising height of the input tray at any time to ensure the pickup roller of the pickup assembly to press downward on the paper with the stable positive force to proceed the picking up paper action. So that it effectively avoids phenomena of empty catching and picking up the paper without strength to pick up the paper stably and powerfully. Therefore, the paper feeding mechanism has a simple structure and a lower manufacturing cost.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
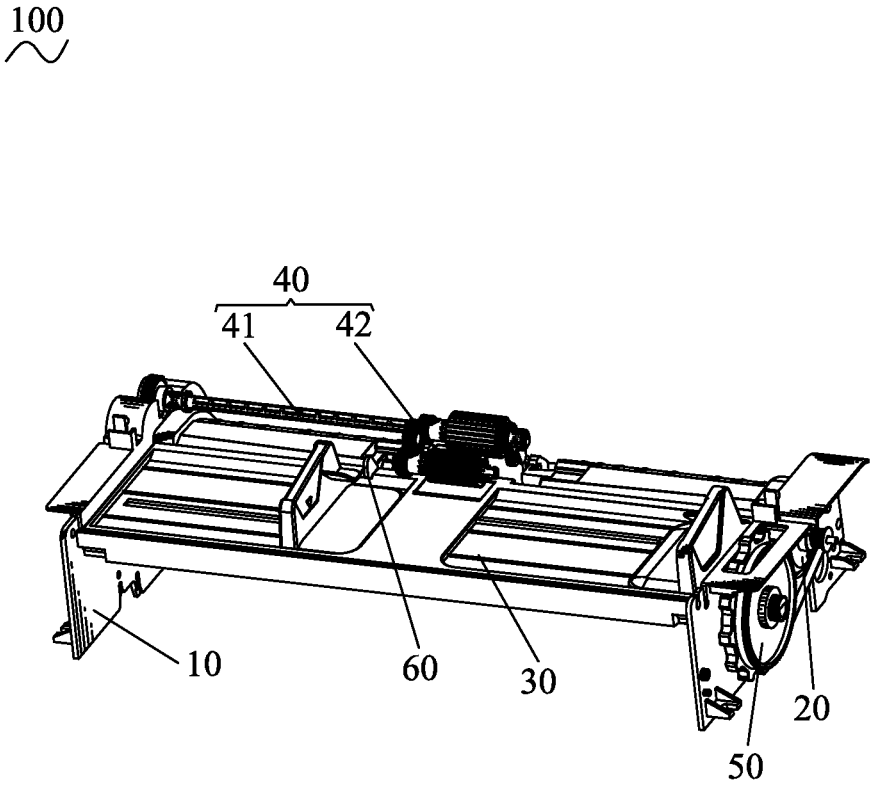
FIG. 1 is a perspective view of a paper feeding mechanism in accordance with an embodiment of the present invention.
Figure 2:
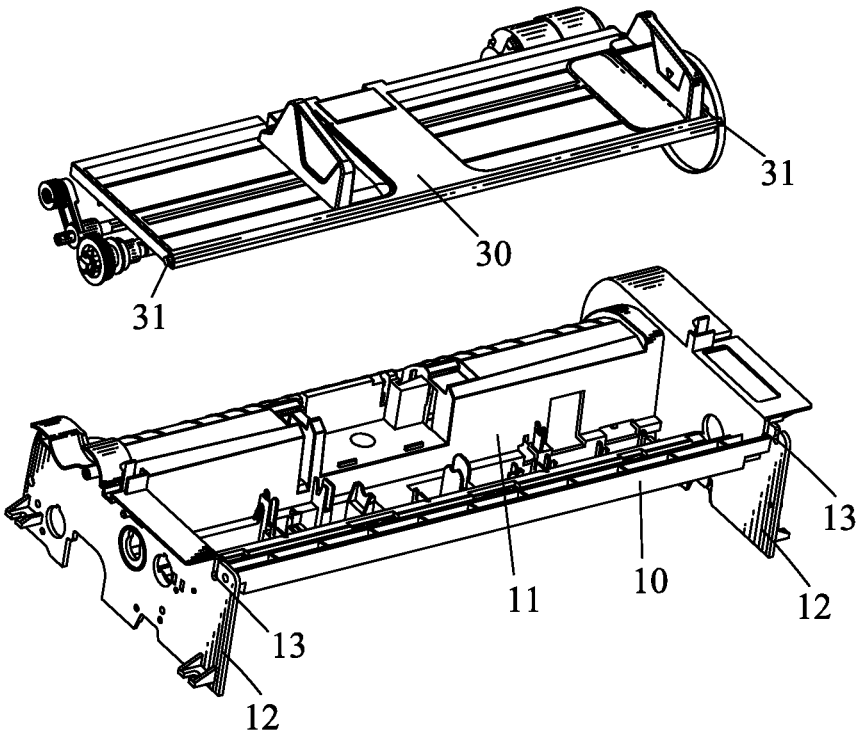
FIG. 2 is a partially exploded view of the paper feeding mechanism of FIG. 1.
Figure 3:
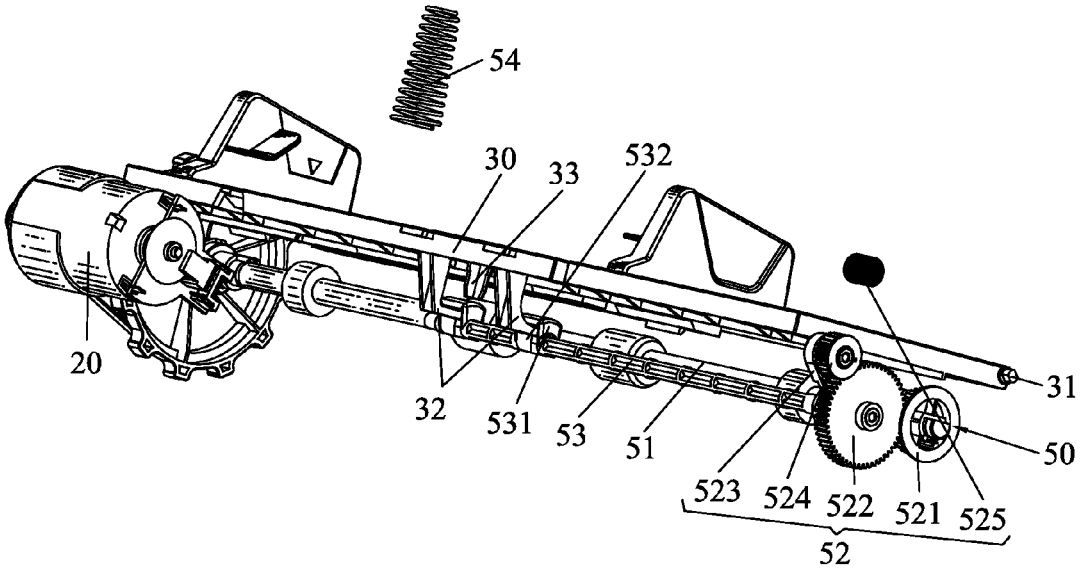
FIG. 3 is another partially exploded view of the paper feeding mechanism of FIG. 1.
Figure 4:
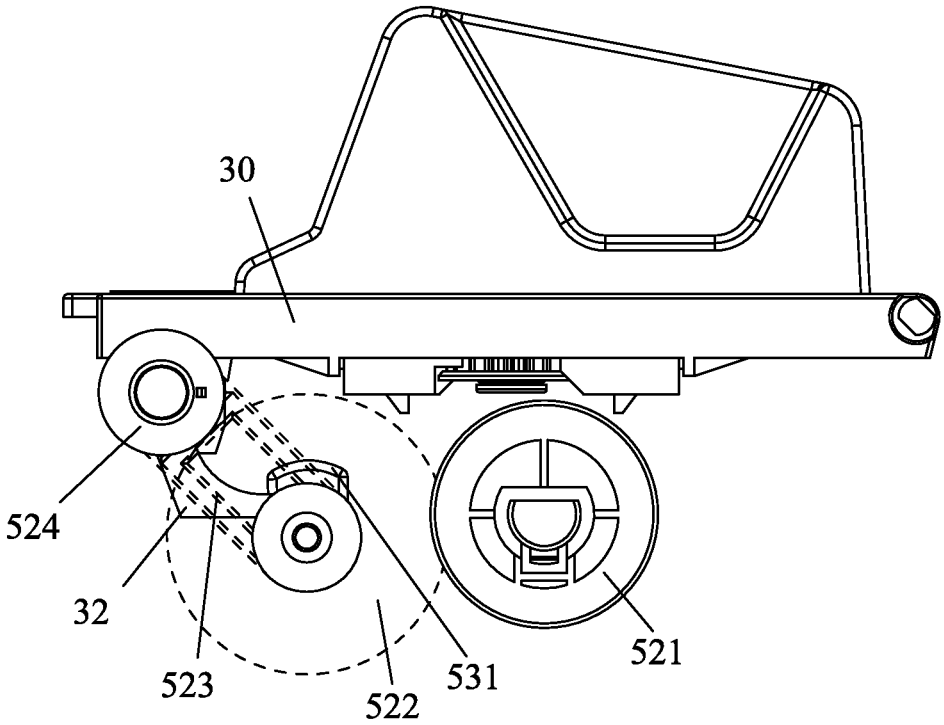
FIG. 4 is a lateral view showing a picking up paper status of the paper feeding mechanism of FIG. 1.
Figure 5:
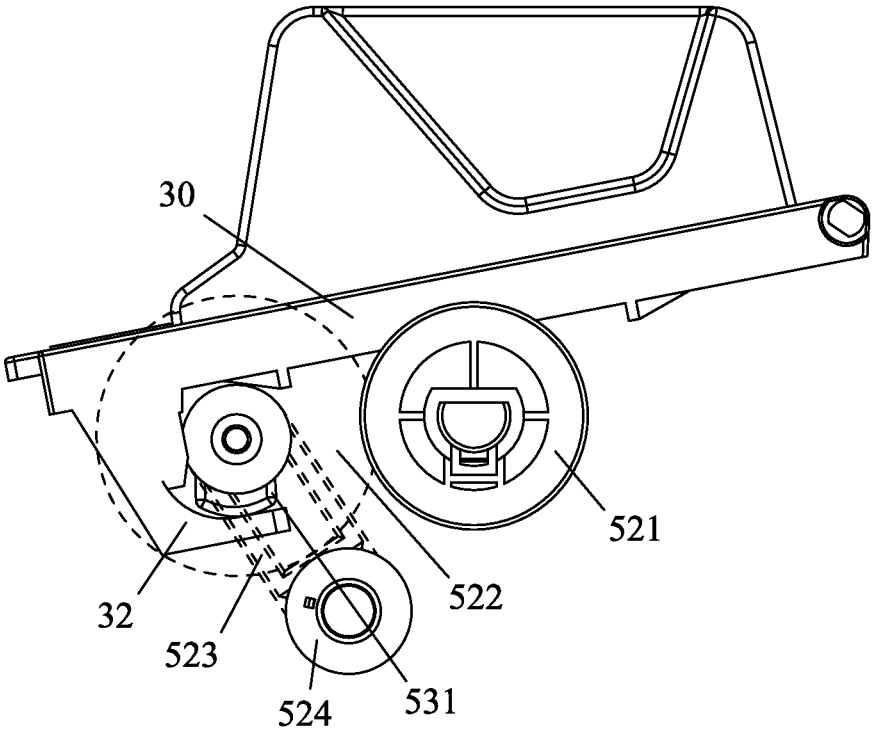
FIG. 5 is a lateral view showing a placing paper status of the paper feeding mechanism of FIG. 1.

With reference to FIG. 1 to FIG. 3, a paper feeding mechanism 100 in accordance with an embodiment of the present invention is shown. The paper feeding mechanism 100 is adapted for being applied in an automatic document feeder (not shown). The paper feeding mechanism 100 includes a mechanical frame 10, a drive assembly 20 mounted to the mechanical frame 10, an input tray 30, a pickup assembly 40, an elevating assembly 50, a control assembly (not labeled) and a cover (not shown). The drive assembly 20, the input tray 30, the pickup assembly 40 and the elevating assembly 50 are respectively assembled to the mechanical frame 10, and the pickup assembly 40 and the elevating assembly 50 are driven by the drive assembly 20.

Referring to FIG. 1 to FIG. 4, a middle of the mechanical frame 10 opens an accommodating groove 11 penetrating through a top thereof. Two fronts of two opposite side walls of the accommodating groove 11 extend forward to form two extending walls 12. The two extending walls 12 define two pivoting holes 13.

Referring to FIG. 1, the drive assembly 20 is mounted to one side of the mechanical frame 10.

Referring to FIG. 1, FIG. 2 and FIG. 3, the input tray 30 for loading a stack of paper thereon is accommodated in the accommodating groove 11. A front end of the input tray 30 is pivoted to the mechanical frame 10 and a rear end of the input tray 30 swings upward around the front end of the input tray 30 to be raised up a distance from the mechanical frame 10. Specifically, two opposite sides of the front end of the input tray 30 extend oppositely to form two pivoting pillars 31. The two pivoting pillars 31 are pivoted in the two pivoting holes 13 of the mechanical frame 10 so as to pivot the front end of the input tray 30 to the mechanical frame 10. Two portions of a bottom of the rear end of the input tray 30 extend downward and then extend forward to form two pressing portions 32. The bottom of the rear end of the input tray 30 protrudes downward to form a fastening pillar 33 located between the two pressing portions 32.

Referring to FIG. 1, the pickup assembly 40 is driven by the drive assembly 20. The pickup assembly 40 is mounted to the mechanical frame 10 and is located above the rear end of the input tray 30. The pickup assembly 40 includes a pickup shaft 41 and a pickup roller 42 pivoted to one end of the pickup shaft 41. The other end of the pickup shaft 41 is fastened to the mechanical frame 10 for securing the pickup assembly 40 to the mechanical frame 10. The pickup roller 42 is capable of grabbing paper in a stable positive force to proceed picking up the paper.

Referring to FIG. 2, FIG. 3, FIG. 4 and FIG. 5, the elevating assembly 50 is mounted to the mechanical frame 10 and is pivoted to the bottom of the rear end of input tray 30. The elevating assembly 50 includes a drive shaft 51 mounted to the mechanical frame 10 with one end thereof connecting with the drive assembly 20 and driven by the drive assembly 20, a gear assembly 52 connecting with the drive shaft 51, a rotating shaft 53 driven by the gear assembly 52 to rotate and located under the input tray 30, and an elastic element 54. The gear assembly 52 is mounted to the other side of the mechanical frame 10. Specifically, the gear assembly 52 includes an actuating gear 521 mounted to the drive shaft 51, a drive gear 522 engaging with the actuating gear 521, a swing arm 523 coaxially pivoted with the drive gear 522, a spindle gear 524 connecting with the swing arm 523 and engaging with the drive gear 522, and a torsion spring 525 mounted between the swing arm 523 and the spindle gear 524. One end of the rotating shaft 53 is mounted to the drive gear 522 of the gear assembly 52 and the other end of the rotating shaft 53 passes through the mechanical frame 10 to be located in the accommodating groove 11.

Referring to FIG. 2, FIG. 3, FIG. 4 and FIG. 5, one end of the rotating shaft 53 is connected with the gear assembly 52 to connect with the drive assembly 20, and the other end of the rotating shaft 53 passes through the mechanical frame 10 to be located in the accommodating groove 11. The rotating shaft 53 defines two cam parts 531 projecting beyond the rotating shaft 53. The cam part 531 defines a notch 532 passing through a bottom and a rear thereof. One end of the elastic element 54 resists against the mechanical frame 10 and the other end of the elastic element 54 is worn around the fastening pillar 33 to restrain the elastic element 54 between the mechanical frame 10 and the input tray 30. The rotating shaft 53 is capable of rotating to make the cam parts 531 press downward on or break away from the input tray 30 so as to drive the input tray 30 to swing downward or swing upward under an elastic push action of the elastic element 54. Specifically, the rotating shaft 53 is capable of rotating anticlockwise to make the cam parts 531 press downward on the pressing portions 32 so as to drive the input tray 30 to swing downward. The rotating shaft 53 is capable of rotating clockwise to make the pressing portions 32 project into the notches 532 of the cam parts 531 to break away from the input tray 30 so as to drive the input tray 30 to swing upward under an elastic push action of the elastic element 54 to a pickup position (shown in FIG. 4).

Referring to FIG. 1, FIG. 2, FIG. 3 and FIG. 4, the control assembly includes a control system (not shown) and a paper sensor 60 controlled by the control system for detecting whether there is any paper on the input tray 30. The control assembly controls the drive assembly 20 to drive the elevating assembly 50 to rise or descend so as to bring along the input tray 30 to swing upward or downward and drive the pickup assembly 40 to pick up the paper or stop picking up the paper. Specifically, the paper sensor 60 is mounted on the input tray 30 with one end thereof projecting beyond a top surface of the input tray 30. The paper sensor 60 has a sensing portion (not shown) for launching sensing beams, the paper obstructs the sensing beams launched by the sensing portion to generate a detecting signal and the detecting signal is transmitted to the control system to be processed.

The cover is covered on the pickup assembly 40 and the mechanical frame 10.

Referring to FIG. 1 to FIG. 5, a working principle of the paper feeding mechanism 100 is described as follows.

An original status of the paper feeding mechanism 100 in accordance with the embodiment of the present invention is described as follows. When there is no paper placed on the input tray 30, the pickup assembly 40 keeps raising up, the elastic element 54 pushes against the input tray 30 to swing upward to the highest position, the pressing portions 32 are accommodated in the accommodating groove 11 and spaced a distance from a bottom wall of the accommodating groove 11.

When the paper feeding mechanism 100 is started, the drive assembly 20 rotates clockwise to transmit a driving force to the actuating gear 521 and the drive gear 522 and further transmit the driving force to the spindle gear 524 by virtue of the drive shaft 51, and then the spindle gear 524 is locked via the torsion spring 525 to stop rotating, at the moment, the actuating gear 521 drives the rotating shaft 53 to rotate anticlockwise. When the two cam parts 531 of the rotating shaft 53 rotate to the pressing portions 32 of the input tray 30, the cam parts 531 press downward on the pressing portions 32 so as to bring along the rear end of the input tray 30 to swing downward for facilitating placing the stack of paper on the input tray 30 (shown in FIG. 5), at the moment, the elastic element 54 shows a compression status.

After placing the stack of paper on the input tray 30, because the paper sensor is mounted on the input tray 30 with one end thereof projecting beyond the top surface of the input tray 30, the paper touches the paper sensor to send the detecting signal and the paper sensor sends the detecting signal to the control system. The control system controls the drive assembly 20 to rotate anticlockwise, the drive assembly 20 drives the drive shaft 51 and transmits the driving force to the spindle gear 524 by the actuating gear 521 and the drive gear 522, and then the spindle gear 524 is locked via the torsion spring 525 to stop rotating, at the moment, the actuating gear 521 drives the rotating shaft 53 to rotate clockwise, the rotating shaft 53 drives the cam parts 531 to rotate to break away from the pressing portions 32 of the input tray 30, at the moment, the elastic element 54 elastically pushes against the input tray 30 to swing upward to the pickup position (shown in FIG. 4), at the moment, the drive assembly 20 drives the pickup assembly 40 to rotate downward to start picking up the paper, the elastic element 54 elastically pushes against the input tray 30 to modulate a rising height of the input tray 30 at any time to ensure the pickup roller of the pickup assembly 40 to press downward on the paper with the stable positive force to proceed the picking up paper action, so that it effectively avoids phenomena of empty catching and picking up the paper without strength to pick up the paper stably and powerfully.

After completing picking up the stack of paper, the paper sensor sends a detecting signal to the control system, the control system controls the drive assembly 20 to rotate clockwise again to transmit the driving force to the actuating gear 521 and the drive gear 522, at the moment, the actuating gear 521 drives the rotating shaft 53 to rotate anticlockwise so as to make the input tray 30 swing downward for facilitating placing the paper on the input tray 30 next time.

As described above, the rotating shaft 53 defines two cam parts 531 projecting beyond the rotating shaft 53, when the two cam parts 531 of the rotating shaft 53 rotate to the pressing portions 32 of the input tray 30, the cam parts 531 press downward on the pressing portions 32 so as to bring along the rear end of the input tray 30 to swing downward for facilitating placing the stack of paper on the input tray 30. Furthermore, the elastic element 54 elastically pushes against the input tray 30 to modulate the rising height of the input tray 30 at any time to ensure the pickup roller of the pickup assembly 40 to press downward on the paper with the stable positive force to proceed the picking up paper action. So that it effectively avoids phenomena of empty catching and picking up the paper without strength to pick up the paper stably and powerfully. Therefore, the paper feeding mechanism 100 has a simple structure and a lower manufacturing cost.

What is claimed is:

1. A paper feeding mechanism, comprising:

a mechanical frame;

a drive assembly mounted to the mechanical frame;

an input tray, a front end of the input tray being pivoted to the mechanical frame and a rear end of the input tray swinging upward around the front end of the input tray to be raised up a distance from the mechanical frame;

a pickup assembly driven by the drive assembly;

an elevating assembly mounted to the mechanical frame and pivoted to a bottom of the rear end of input tray, the elevating assembly including a drive shaft mounted to the mechanical frame with one end thereof connecting with the drive assembly and driven by the drive assembly, a gear assembly connecting with the drive shaft, a rotating shaft driven by the gear assembly to rotate and located under the input tray, and an elastic element, the rotating shaft defining two cam parts projecting beyond the rotating shaft, the rotating shaft rotating to make the cam parts selectively press downward on and separate from the input tray so as to drive the input tray to respectively swing downward or swing upward under an elastic push action of the elastic element;

wherein the gear assembly is mounted to a side of the mechanical frame, the gear assembly includes an actuating gear mounted to the drive shaft, a drive gear engaging with the actuating gear, a swing arm coaxially pivoted about the drive gear, a spindle gear connecting with the swing arm and engaging with the drive gear, and a torsion spring mounted between the swing arm and the spindle gear, wherein the drive gear is coaxial with the rotating shaft; and a control assembly including a control system and a paper sensor controlled by the control system for detecting whether there is any paper on the input tray, the control assembly controlling the drive assembly to drive the elevating assembly to rise or descend so as to bring along the input tray to swing upward or downward and drive the pickup assembly to pick up the paper or stop picking up the paper.

2. The paper feeding mechanism as claimed in claim 1, wherein a middle of the mechanical frame opens an accommodating groove penetrating through a top thereof, one end of the rotating shaft is mounted to the drive gear of the gear assembly and the other end of the rotating shaft passes through the mechanical frame to be located in the accommodating groove.

3. The paper feeding mechanism as claimed in claim 1, wherein two portions of a bottom of the rear end of the input tray extend downward and then extend forward to form two pressing portions, the cam part defines a notch passing through a bottom and a rear thereof, the rotating shaft is capable of rotating anticlockwise to make the cam parts press downward on the pressing portions so as to drive the input tray to swing downward, and the rotating shaft is capable of rotating clockwise to make the pressing portions project into the notches of the cam parts to separate from the input tray so as to drive the input tray to swing upward under the elastic push action of the elastic element to a pickup position.

4. The paper feeding mechanism as claimed in claim 1, wherein the bottom of the rear end of the input tray protrudes downward to form a fastening pillar, one end of the elastic element resists against the mechanical frame and the other end of the elastic element is worn around the fastening pillar to restrain the elastic element between the mechanical frame and the input tray.

5. The paper feeding mechanism as claimed in claim 1, wherein a middle of the mechanical frame opens an accommodating groove penetrating through a top thereof, two fronts of two opposite side walls of the accommodating groove extend forward to form two extending walls, the two extending walls define two pivoting holes, two opposite sides of the front end of the input tray extend oppositely to form two pivoting pillars, the two pivoting pillars are pivoted in the two pivoting holes of the mechanical frame so as to pivotally mount the front end of the input tray to the mechanical frame.

* * * * *